US009309853B2

(12) United States Patent
Okamoto et al.

(10) Patent No.: US 9,309,853 B2
(45) Date of Patent: Apr. 12, 2016

(54) FUEL INJECTION VALVE AND FUEL INJECTION SYSTEM

(71) Applicant: Hitachi Automotive Systems, Ltd., Hitachinaka-shi, Ibaraki (JP)

(72) Inventors: Yoshio Okamoto, Omitama (JP); Yoshihito Yasukawa, Hitachinaka (JP); Noriyuki Maekawa, Kashiwa (JP); Nobuaki Kobayashi, Maebashi (JP); Takahiro Saito, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 453 days.

(21) Appl. No.: 13/768,564

(22) Filed: Feb. 15, 2013

(65) Prior Publication Data

US 2013/0255640 A1 Oct. 3, 2013

(30) Foreign Application Priority Data

Mar. 30, 2012 (JP) ..... 2012-078786

(51) Int. Cl.
*F02M 61/18* (2006.01)
*F02M 69/04* (2006.01)
(Continued)

(52) U.S. Cl.
CPC ..... *F02M 69/04* (2013.01); *F02M 61/162* (2013.01); *F02M 51/0664* (2013.01); *F02M 61/1806* (2013.01); *F02M 61/1853* (2013.01)

(58) Field of Classification Search
CPC . F02M 61/162; F02M 61/18; F02M 61/1853; F02M 51/0671; F02M 51/061; F02M 61/1826; F02M 61/1806; F02B 2075/125; B23H 3/02; B23H 9/16
USPC ..... 123/478, 301, 302, 308; 239/533.12
See application file for complete search history.

(56) References Cited

U.S. PATENT DOCUMENTS 5,540,200 A * 7/1996 Naitoh ..... F02M 51/065 123/299
5,570,841 A * 11/1996 Pace et al. ..... 239/585.1
(Continued)

FOREIGN PATENT DOCUMENTS

JP 2001-317434 A 11/2001
JP 2002-202031 A 7/2002
(Continued)

OTHER PUBLICATIONS

Chinese Office Action dated Jan. 6, 2015 (Five (5) pages).
(Continued)

*Primary Examiner* — Hai Huynh
*Assistant Examiner* — Gonzalo Laguarda
(74) *Attorney, Agent, or Firm* — Crowell & Moring LLP

(57) ABSTRACT

A fuel injection valve which has: swirl chambers each having an inner wall whose curvature is gradually increased from upstream to downstream along fuel flow; passages for swirling motion, the passages permitting introduction of fuel into the swirl chambers; fuel injection holes opening into the swirl chambers and including at least two narrow-angle injection holes and a wide-angle injection hole from which at least two narrow-angle sprays and a wide-angle spray are respectively ejected; and an orifice plate provided with the injection holes. The narrow-angle injection holes are spaced a given distance from the center of the orifice plate. The wide-angle injection hole is formed on a line perpendicularly intersecting a line segment that interconnects the centers of the narrow-angle injection holes.

7 Claims, 7 Drawing Sheets

(51) Int. Cl.
*F02M 61/16* (2006.01)
*F02M 51/06* (2006.01)

(56) References Cited

U.S. PATENT DOCUMENTS

| | | | | |
|---|---|---|---|---|
| 5,577,481 | A | 11/1996 | Wahba | |
| 5,924,634 | A * | 7/1999 | Arndt | B05B 1/34 239/533.12 |
| 6,142,390 | A * | 11/2000 | Nordstrom et al. | 239/490 |
| 6,308,684 | B1 * | 10/2001 | Konishi | F02M 61/1806 123/432 |
| 6,405,945 | B1 * | 6/2002 | Dobrin | 239/463 |
| 6,588,399 | B2 | 7/2003 | Okamoto et al. | |
| 6,755,024 | B1 * | 6/2004 | Mao et al. | 60/776 |
| 6,854,670 | B2 * | 2/2005 | Sumisha et al. | 239/543 |
| 8,882,003 | B2 * | 11/2014 | Okamoto et al. | 239/533.12 |
| 8,888,021 | B2 * | 11/2014 | Yasukawa et al. | 239/533.12 |
| 9,157,403 | B2 * | 10/2015 | Saito | F02M 61/162 |
| 2002/0050266 | A1 | 5/2002 | Okamoto et al. | |
| 2003/0116650 | A1 * | 6/2003 | Dantes et al. | 239/463 |
| 2003/0141385 | A1 * | 7/2003 | Xu | 239/463 |
| 2003/0234005 | A1 | 12/2003 | Sumisha et al. | |
| 2005/0133378 | A1 * | 6/2005 | Glock et al. | 205/651 |
| 2014/0252132 | A1 * | 9/2014 | Jeannel et al. | 239/482 |

FOREIGN PATENT DOCUMENTS

| | | | |
|---|---|---|---|
| JP | 2002-364496 | A | 12/2002 |
| JP | 2003-336562 | A | 11/2003 |
| JP | 2004-28078 | A | 1/2004 |
| JP | 2008-255912 | A | 10/2008 |
| JP | 2008-280981 | A | 11/2008 |
| JP | 2009-79598 | A | 4/2009 |

OTHER PUBLICATIONS

Japanese Office Action dated May 12, 2015 with English-language translation (eight (8) pages).
Chinese-language Office Action dated Jun. 12, 2015 (six (6) pages).

* cited by examiner

SPRAYS 30, 31 URGE ATOMIZED SPRAY 32 DOWNWARD (TOWARD CENTRAL PARTITION WALL OF INTAKE VALVE)

FUEL INJECTION VALVE AND FUEL INJECTION SYSTEM

BACKGROUND OF THE INVENTION

The present invention relates to a fuel injection valve for use with an internal combustion engine and, more particularly, to a fuel injection valve which has plural fuel injection holes, each injecting swirling fuel to promote atomization of the fuel, and which can control the spray pattern.

A fuel injection valve set forth in JP-A-2008-280981 is known as a conventional technique for achieving promotion of atomization of fuel sprayed from plural fuel injection holes and controlling the spray pattern by making use of swirling stream.

This fuel injection valve has a valve body capable of being opened and closed to permit and stop injection of fuel, a seat portion capable of being brought into intimate contact with the valve body to stop injection of fuel, and an orifice plate disposed downstream of both the valve body and the seat portion and having fuel injection holes from which fuel is ejected. Atomized, curved swirling spray is ejected from the fuel injection holes.

Furthermore, in this fuel injection valve, the orifice plate has the fuel injection holes from which fuel is sprayed, a swirling chamber in which fuel is swirled, and a fuel intake passage for introducing fuel into the swirling chamber. The center of each fuel injection hole is offset a different amount from the center axis of the fuel intake passage. The fuel injection hole having a smaller amount of offset sprays atomized fuel over a smaller angle. The fuel injection holes having larger amounts of offset provide plural sprays of swirling and curved atomized fuel.

Owing to this configuration, the amount of fuel adhering to the intake valve (bottom) of the engine and to the inner wall surface of the cylinder is reduced. As a result, a homogeneous air-fuel mixture is produced. Hence, a decrease in the amount of soot contained in the exhaust gas and higher engine output can be accomplished.

On the other hand, a fuel injection valve set forth in JP-A-2001-317434 is known as a conventional technique for obtaining a highly atomized spray by making use of a swirling force.

In this fuel injection valve, the outer surface of each fuel injection hole for ejecting swirled fuel on the exit side is formed by first and second surfaces. The first surface includes the exit of the fuel injection hole. The second surface is spaced from the fuel injection hole, has a wall opposite to the ejected spray, and protrudes from the first surface. Thus, the ejected spray consists of a central portion and an outer portion. The outer portion is composed of a thick spray portion having a wide spread circumferentially and a thin spray portion having a narrow spread. As a result, the spray is shaped in an integrated flattened form.

This flattened spray form permits the thick spray portion having a wide spread to be directed toward the inner wall surface that is opposite to the inner wall of the intake pipe on which a fuel injection valve is disposed. Furthermore, the thick spray portion can be symmetrically directed toward the central partition wall located in the center of the intake valve. Consequently, fuel and air can be mixed efficiently while suppressing fuel deposition on the inner wall surface of the intake pipe. Thus, purification of exhaust emission and improvement of the fuel consumption can be accomplished.

SUMMARY OF THE INVENTION

It is known that if swirled fuel is sprayed, the spray assumes a hollow conical form. Since this kind of spray has a high degree of atomization, the ejected spray shows a less penetration. Furthermore, the spray is easily biased in a certain direction under the influences of motion of air within the ambient into which the spray is injected and of flow of the gas. In consequence, the spray structure needs to be designed ingeniously. For example, a desired function needs to be imparted to arbitrary portions of the spray.

In the conventional technique set forth in the above-cited JP-A-2008-280981, the center of each fuel injection hole is offset relative to the center axis of the fuel intake passage. A spray of a narrow angle is produced from each fuel injection hole having a smaller amount of offset. On the other hand, a curved spray of a wide angle is created from each fuel injection hole having a larger amount of offset. The curved sprays are plural in number and directed in different directions without in contact with each other. With such a spray structure, sprays narrow angle and sprays of wide angle minimally affect each other. Accordingly, when the spray structure (such as spread of each spray or penetration) is modified, it follows that the amount of offset of the fuel intake passage is varied. In this technique, the diameters of grain particles of spray are varied or the spray pattern is varied greatly. It can be said that this is undesirable for the design.

In the conventional technique set forth in the above-cited JP-A-2001-317434, it is possible to vary the shape of the spray structure consisting of thick spray portions of wide angle and thin spray portions of narrow angle but it is difficult to greatly vary the spray pattern.

In view of the foregoing circumstances, the present invention has been made. It is an object of the present invention to provide a fuel injection valve capable of better controlling the shape of a fuel spray structure by appropriately adjusting the injection characteristics of fuel injection holes (such as direction, strength of swirling motion, and distance) from which swirled fuel is ejected.

The present invention provides a fuel injection valve having: swirl chambers having inner walls whose curvature is gradually increased from upstream to downstream along flow of fuel; passages for swirling motion, the passages permitting introduction of fuel into the swirl chambers; fuel injection holes opening into the swirl chambers and including at least two narrow-angle injection holes and a wide-angle injection hole from which at least two narrow-angle sprays and a wide-angle spray are respectively ejected; and an orifice plate provided with the injection holes and having a center. The narrow-angle injection holes are spaced a given distance from the center of the orifice plate. The wide-angle injection hole is formed on a line perpendicularly intersecting a line segment that interconnects the centers of the narrow-angle injection holes.

According to the present invention, the narrow-angle sprays are ejected from weakly swirling chambers where weakly swirled fuel is created. The wide-angle spray where higher levels of atomization are achieved is ejected from a strongly swirling chamber in which strongly swirled fuel is created. The narrow-angle sprays can prevent scattering of the wide-angle spray and urge the wide-angle spray downward. In consequence, a spray structure which has good levels of atomization and whose shape or pattern can be controlled well can be formed.

Other objects, features and advantages of the invention will become apparent from the following description of the embodiments of the invention taken in conjunction with the accompanying drawings.

DESCRIPTION OF THE EMBODIMENTS

The preferred embodiments of the present invention are hereinafter described with reference to FIGS. 1-10.

Embodiment 1

The first embodiment (embodiment 1) of the present invention is described below by referring to FIGS. 1-6.

Figure 1:
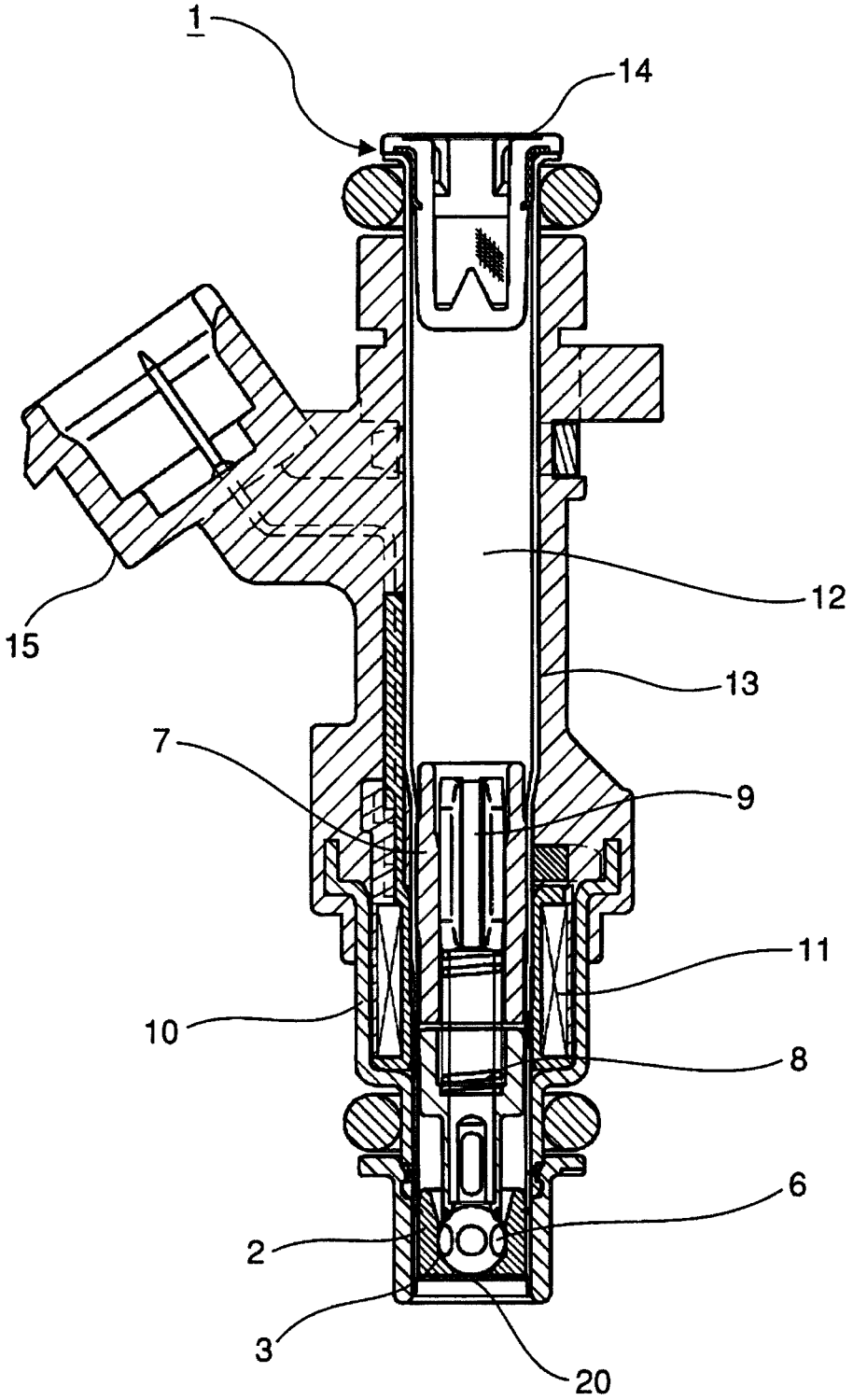
FIG. 1 is a vertical cross section showing the whole structure of an embodiment of a fuel injection valve associated with the present invention.

FIG. 1 is a vertical cross section showing the whole structure of a fuel injection valve associated with the present invention, the valve being indicated by reference numeral 1. In FIG. 1, the fuel injection valve 1 includes a thin-walled pipe 13 made of stainless steel. A nozzle body 2 and a valve body 6 are accommodated within the pipe 13. An electromagnetic coil 11 is disposed outside the valve body 6 to open and close the valve body 6. Details of this structure are described below.

Figure 2:
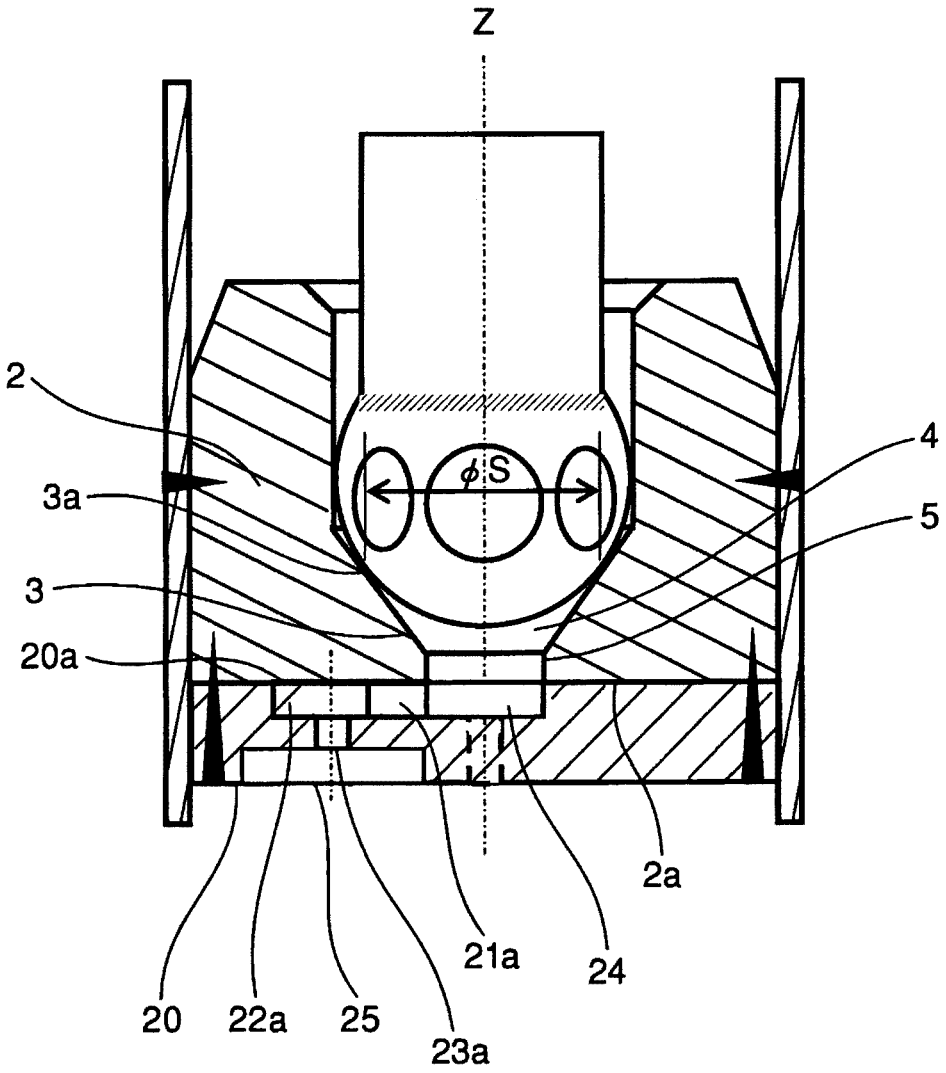
FIG. 2 is a vertical cross section showing vicinities of a nozzle body included in the fuel injection valve shown in FIG. 1.
Figure 3:
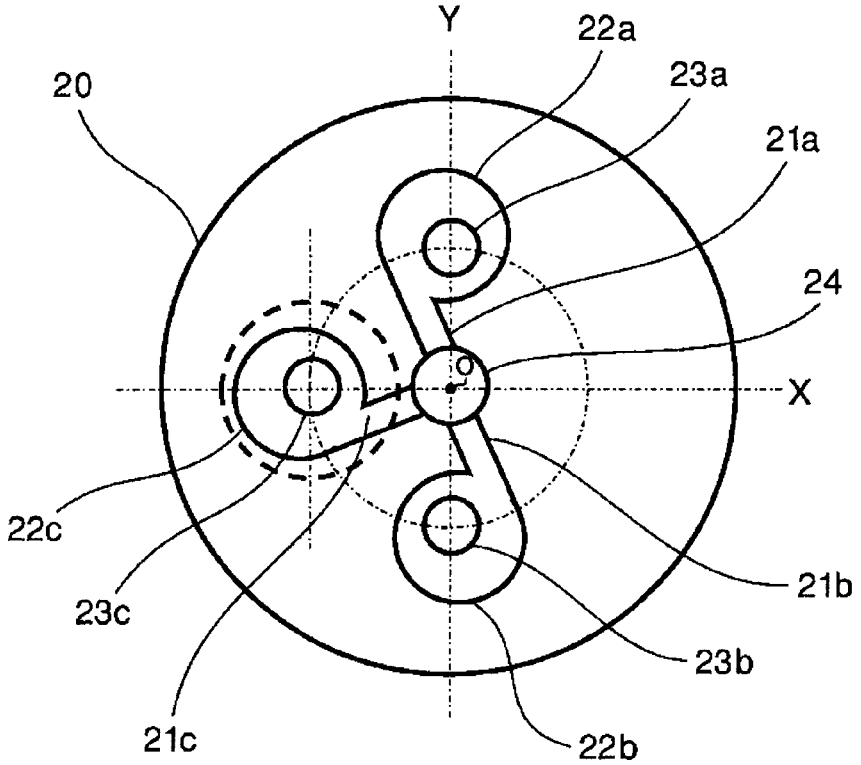
FIG. 3 is a plan view of an orifice plate located at the lower end of the nozzle body shown in FIG. 2, taken from the valve body side.
Figure 4:
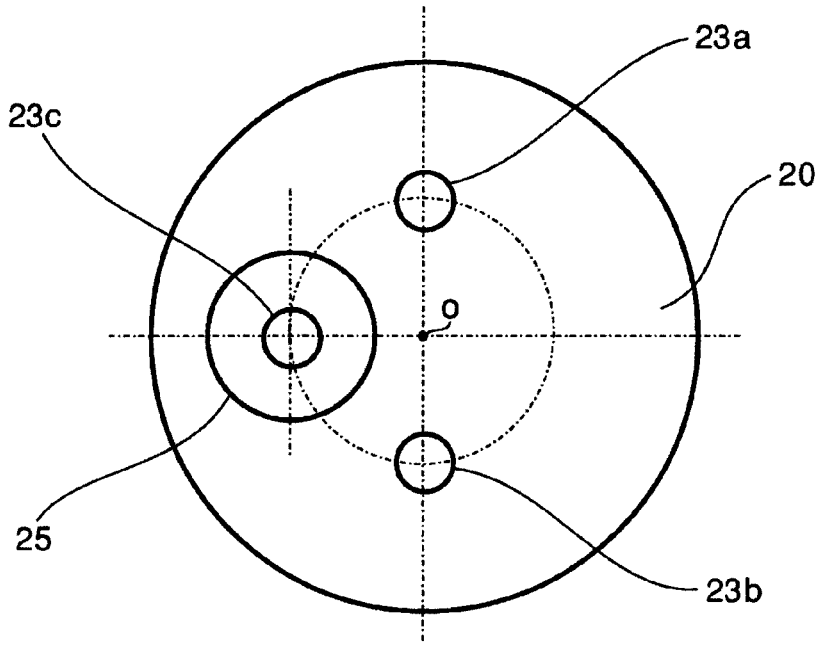
FIG. 4 is a plan view of the orifice plate located at the lower end of the nozzle body shown in FIG. 2, taken from the exit side.

The fuel injection valve 1 has a yoke 10 made of a magnetic material around the electromagnetic coil 11, a core 7 located at the center of the coil 11 and having its one end magnetically coupled to the yoke 10, the aforementioned valve body 6 capable of being lifted a given distance, a valve seat surface 3 in contact with the valve body 6, a fuel injection chamber 4 (see FIG. 2) permitting passage of fuel flowing through the gap between the valve body 6 and the valve seat surface 3, and an orifice plate 20 located downstream of the fuel injection chamber 4 and provided with a plurality of fuel injection holes 23*a*, 23*b*, 23*c* (see FIGS. 2-4).

A spring 8 acting as a resilient member pushing the valve body 6 against the valve seat surface 3 is mounted in the center of the core 7. The resilient force of the spring 8 is adjusted by the extent to which a spring adjuster 9 is pushed in toward the valve seat surface 3.

When the coil 11 is not electrically energized, the valve body 6 is kept in intimate contact with the valve seat surface 3. Under this condition, the fuel passage is closed and, therefore, fuel stays in the fuel injection valve 1 and is prevented from being ejected from the fuel injection holes 23*a*, 23*b*, 23*c*.

On the other hand, when the coil 11 is electrically energized, the resulting electromagnetic force moves the valve body 6 into contact with the opposite, lower end surface of the core 7.

When the valve is open in this way, a gap is created between the valve body 6 and the valve seat surface 3 and so the fuel passage is opened to permit fuel to be ejected from the fuel injection holes 23*a*, 23*b*, 23*c*.

The fuel passage 12 having a filter 14 in its entrance is formed in the fuel injection valve 1. The passage 12 includes a hole portion extending through the center of the core 7. The fuel passage 12 guides fuel under pressure by a fuel pump (not shown) through the fuel injection valve 1 into the fuel injection holes 23*a*, 23*b*, 23*c*. The fuel injection valve 1 is coated on its outside with a molded plastic part 15 such that the valve is electrically insulated.

As described previously, the position of the valve body 6 is switched in response to injection pulses to the coil 11 such that it is electrically energized, whereby the fuel injection valve 1 is opened and closed. Thus, the amount of supplied fuel is controlled.

To control the amount of supplied fuel, the valve body is designed so that fuel does not leak, especially when the valve is closed.

In this type of fuel injection valve, a mirror-finished ball (such as a steel ball adapted as a ball bearing conforming with the Japanese Industrial Standards) having a high degree of circularity is used as the valve body 6. This is advantageous for improvement of the seatability.

The valve seat angle of the valve seat surface 3 with which the ball makes intimate contact is set to an optimum angle, from 80 degrees to 100 degrees, at which good grindability can be obtained and which permits the degree of circularity to be achieved accurately. The dimensions of the valve seat surface are so set that the ball can be kept seated on it quite well.

The hardness of the nozzle body 2 having the valve seat surface 3 has been enhanced by quenching. Furthermore, unwanted magnetism has been removed from the nozzle body by demagnetization.

This structure of the valve body 6 permits leakproof control of fuel delivery rate.

FIG. 2 is a vertical cross section of vicinities of the nozzle body 2 of the fuel injection valve 1 associated with the present invention. As shown in FIG. 2, the top surface 20*a* of the orifice plate 20 is in contact with the bottom surface 2*a* of the nozzle body 2. The outer periphery of this contacting portion is secured to the nozzle body 2 by laser welding.

In the present specification including the claims, the up and down direction is defined as shown in FIG. 1. In particular, it is assumed that, in the direction of the axial center of the fuel injection valve 1, the fuel passage 12 is located on the upper side, while the orifice plate 20 having the fuel injection holes 23*a*-23*c* is assumed to be located on the lower side.

A fuel intake hole 5 having a diameter smaller than the diameter $\phi S$ of the seat portion 3*a* of the valve seat surface 3 is formed in the lower end of the nozzle body 2. The valve seat surface 3 is conical in shape. The fuel intake hole 5 is formed in the center of the downstream end of the valve seat surface 3. The valve seat surface 3 and the fuel intake hole 5 are so formed that the center line of the valve seat surface 3 and the center line of the fuel intake hole 5 are coincident with the axial center Z of the valve. The fuel intake hole 5 forms an opening in the lower end surface of the nozzle body 2, the opening being in communication with a central hole 24 in the orifice plate 20.

The central hole 24 is concave and formed in the top surface 20*a* of the orifice plate 20. Passages 21*a*, 21*b*, and 21*c* for swirling motion extend radially from the central hole 24. The passages 21*a*, 21*b*, and 21*c* for swirling motion have upstream ends which open into the inner surface of the central hole 24 and are in communication with the central hole 24.

The downstream end of the passage 21*a* for swirling motion, the downstream end of the passage 21*b* for swirling motion, and the downstream end of the passage 21*c* for swirling motion are communicatively connected to the swirl chambers 22*a*, 22*b*, and 22*c*, respectively. The passages 21*a*, 21*b*, and 21*c* for swirling motion are fuel passages permitting fuel to be supplied into the swirl chambers 22*a*, 22*b*, and 22*c*, respectively. In this meaning, the swirl passages 21*a*, 21*b*, and 21*c* may be referred to as swirling fuel supply passages 21*a*, 21*b*, and 21*c*, respectively.

The wall surfaces of the swirl chambers 22*a*, 22*b*, and 22*c* are so formed that they gradually increase in curvature (decrease in radius of curvature) from upstream to downstream. The curvatures may continuously increase. Alternatively, the curvatures may increase in steps from upstream to downstream, i.e., the curvatures are kept constant within a given range.

One typical example of a curve whose curvature increases gradually from upstream to downstream is an involute curve. Another example is a spiral curve. In the present embodiment, a spiral curve is taken as an example. A different curve as described above which gradually increases in curvature from upstream to downstream may similarly be adopted.

The narrow-angle injection holes 23*a* and 23*b* and the wide-angle injection hole 23*c* open into the centers of the swirl chambers 22*a*, 22*b*, and 22*c*, respectively.

The nozzle body 2 and orifice plate 20 are so configured that they can be placed in position easily and that they can be assembled together at enhanced dimensional accuracy.

The orifice plate 20 is fabricated by press forming that is advantageous for mass productivity. It is conceivable that other method such as electric discharge machining, electroforming, or etching which gives high machining accuracy without applying large stresses could be adopted.

The structure of the orifice plate 20 is next described in detail by referring to FIGS. 3 and 4. FIG. 3 is a plan view of the orifice plate 20 of the fuel injection valve 1 associated with the present invention, the orifice plate being located at the lower end of the nozzle body. FIG. 3 is a view of the orifice plate 20, taken from above it. FIG. 4 is also a plan view of the orifice plate 20, taken from below it.

The orifice plate 20 is provided with the central hole 24 in communication with the fuel intake hole 5. The three passages 21*a*, 21*b*, and 21*c* for swirling motion extend radially outwardly, are connected to the central hole 24, and are arranged in an opposite relation to each other.

If the outside diameter of the central hole 24 is set equal to the width of the passages 21*a*-21*c* for swirling motion, the flow through the passages 21*a*-21*c* is not hindered at all.

The downstream end of one passage 21*a* for swirling motion communicatively opens into the entrance of the swirl chamber 22*a*. The narrow-angle injection hole 23*a* opens into the center of the swirl chamber 22*a*.

In the present embodiment, the inner wall of the swirl chamber 22*a* is formed so as to draw a spiral curve on a plane (cross section) perpendicular to the center axis (Z in FIG. 2) of the valve. That is, the inner wall assumes a spiral form. The center of the spiral curve is coincident with the center of the narrow-angle injection hole 23*a*.

Where the swirl chamber 22*a* is formed as an involute curve, the center of the basic circle of the involute curve is preferably coincident with the center of the narrow-angle injection hole 23*a*.

The narrow-angle injection hole 23*a* is spaced a given distance from the center O of the orifice plate 20.

The swirl chamber 22*b* and the narrow-angle injection hole 23*b* are in communication with the downstream end of the other passage 21*b* for swirling motion. This swirl chamber 22*b* is designed in the same way as the swirl chamber 22*a*.

The narrow-angle injection hole 23*b* is spaced a given distance from the center O of the orifice plate 20.

The swirl chamber 22*c* and wide-angle injection hole 23*c* are in communication with the downstream end of the further passage 21*c* for swirling motion. This swirl chamber 22*c* is designed in the same way as the swirl chamber 22*a*.

The wide-angle injection hole 23*c* is formed on a line that is at right angles to a line segment intersecting the center of the narrow-angle injection hole 23*a* and the center of the narrow-angle injection hole 23*b*.

The swirl chambers 22*a* and 22*b* are arranged on the Y-axis as shown in FIG. 3 and disposed in a desired position via the central hole 24. Their details will be described later.

The swirl chamber 22*a* is arranged on the Y-axis. Therefore, the narrow-angle injection hole 23*a* located at the (vertical) center of the swirl chamber 22*a* drawing a spiral curve and the narrow-angle injection hole 23*b* located at the center of the swirl chamber 22*b* are arranged on the Y-axis.

As shown in FIG. 4, a concave air guide hole 25 is formed on the exit side of, and coaxially with, the wide-angle injection hole 23*c*.

Because of this structure, the axial length $l_1$ (FIG. 5) of the wide-angle injection hole 23*c* is made smaller than the length $l_2$ (FIG. 5) of the other narrow-angle injection holes 23*a* and 23*b*.

Figure 5:
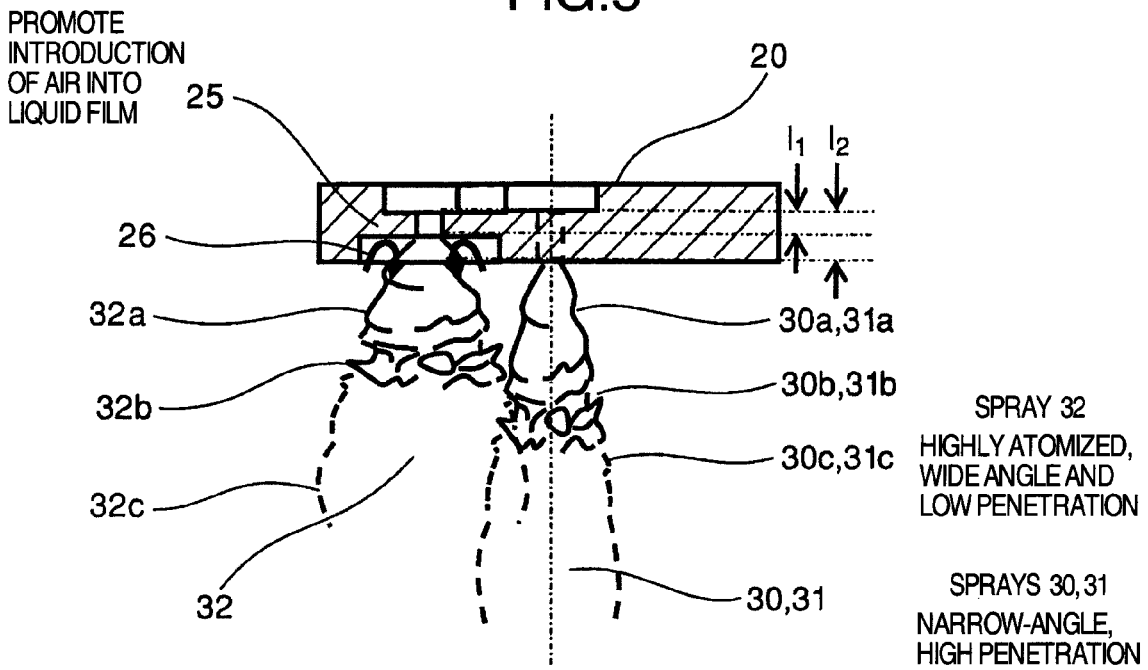
FIG. 5 schematically shows the spray pattern created by an embodiment of a fuel injection valve associated with the present invention, and in which sprays ejected from the fuel injection holes shown in FIG. 3 are viewed along the Y-axis.

As a result, a stream that draws in air is generated as indicated by arrows 26 in FIG. 5. This promotes atomization of the fuel.

Figure 6:
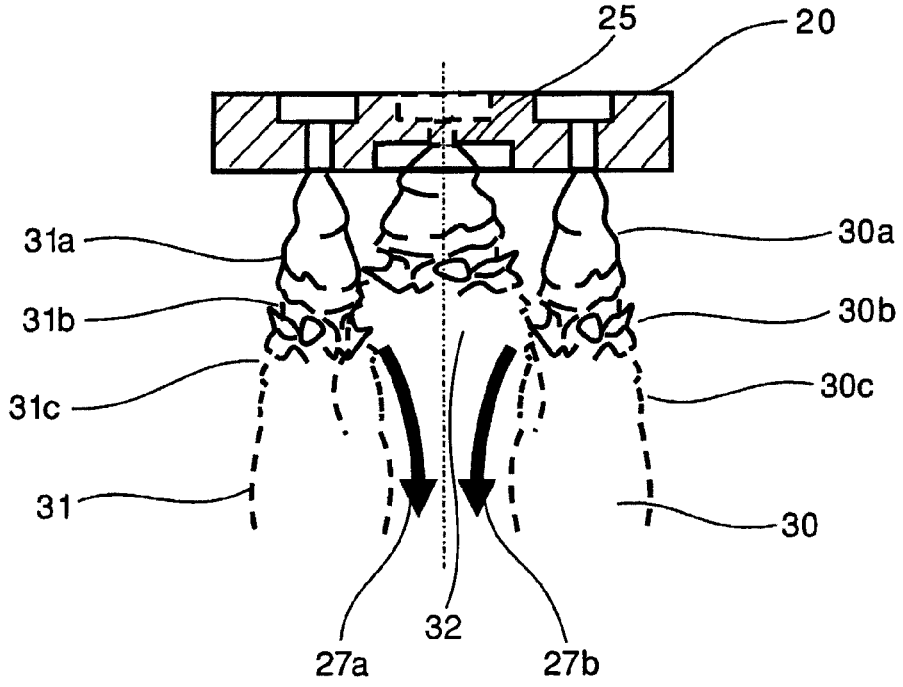
FIG. 6 schematically shows the spray pattern created by an embodiment of a fuel injection valve associated with the present invention, and in which sprays ejected from the fuel injection holes shown in FIG. 3 are viewed along the X-axis.

Patterns of sprays of the ejected fuel, the positional relationship between the sprays, and their mutual interaction are next described by referring to FIGS. 5 and 6.

FIG. 5 is a view of sprays ejected from the narrow-angle injection holes 23*a*, 23*b* and wide-angle injection hole 23*c* arranged as shown in FIG. 3, taken along the Y-axis. FIG. 5 is a schematic representation of an image photographically obtained from the sprays while delaying strobe light or laser light by arbitrary times from a drive signal for the fuel injection valve. Similarly, FIG. 6 is a schematic representation of sprays, taken along the X-axis.

Narrow-angle sprays 30 and 31 have been ejected from the narrow-angle injection holes 23*a* and 23*b*, respectively. A wide-angle spray 32 has been ejected from the wide-angle injection hole 23*c*.

Since the swirl chambers 22*a* and 22*b* weakly swirl fuel, the sprays 30 and 31 are narrow-angle sprays. The narrow-angle sprays 30 and 31 consist of filmy liquid regions 30*a*, 31*a* formed over relatively long ranges, split regions 30*b*, 31*b* generated by filamentary liquid caused by flapping caused by the velocity difference with the atmosphere, and atomized spray regions 30*c*, 31*c*, respectively.

On the other hand, the spray 32 is a wide-angle spray because the swirl chamber 22*c* strongly swirls fuel. Since the liquid film of this wide-angle spray 32 is thinned, the liquid film region 32*a* is short and thus filamentary liquid is created quickly in the split region 32*b*. Consequently, a transition to an atomized region 32*c* is made quickly. Also, the distance traveled to this atomized region is short.

The air guide hole 25 formed at the exit of the wide-angle injection hole 23*c* acts to stabilize flow of air created by the generation of the wide-angle spray 32 and to supply the flow to the liquid film region 32*a*. The guide hole contributes to splitting of the liquid film region 32*a*, i.e., contributes to promotion of atomization.

As is obvious from the figure, considerations are given to the narrow-angle sprays 30, 31 and to the wide-angle spray 32 such that no collision occurs among the filmy liquid regions 30*a*, 31*a*, and 32*a*. This indicates that the grain diameters are prevented from increasing. That is, our experimental analysis has demonstrated that if the liquid film regions collide against each other as they are, the energy causing atomization of fuel made into a thin film by swirling force will be lost and that the film will be thickened conversely, leading to increases in grain diameters.

FIG. 6 is a view of the orifice plate 20 shown in FIG. 3, taken along the X-axis. FIG. 6 schematically shows the ejected sprays 30, 31, and 32. The three sprays 30, 31, and 32 are so formed that they do not collide with each other in the filmy liquid regions 30*a*, 31*a*, and 32*a*. The narrow-angle sprays 30 and 31 are made to flow downwardly with strong force, creating flows of air as indicated by the arrows 27*a* and 27*b*. These flows of air urge liquid droplets generated by the wide-angle spray 32 downward. As a result, spread of the whole spray structure is suppressed and the fuel spray travel can be extended downward.

The cross sections of the swirling passages 21*a*, 21*b*, and 21*c* taken perpendicularly to the direction of flow are rectangular. The swirling passages 21*a*, 21*b*, and 21*c* are so designed that their heights are made small compared with their widths. This is advantageous for press forming.

Since fuel flowing into the passages 21*a*, 21*b*, and 21*c* for swirling motion is restricted by their rectangular portions having their minimum areas, the loss of pressure of the fuel experienced when flowing from the seat portion 3*a* of the valve seat surface 3 to the swirling passages 21*a*, 21*b*, and 21*c* through the fuel injection chamber 4, fuel intake hole 5, and central hole 24 in the orifice plate 20 can be neglected.

Especially, the fuel intake hole 5 and the central hole 24 in the orifice plate 20 are so designed that they form fuel passageways of a desired size to prevent occurrence of pressure loss due to steep bending.

Accordingly, the pressure energy of the fuel is efficiently converted into velocity energy of swirling motion by the passages 21*a*, 21*b*, and 21*c* for swirling motion.

The flow of fuel accelerated by these rectangular portions is guided into the downstream narrow-angle injection holes 23*a*, 23*b* and wide-angle injection hole 23*c*, while the strength of the swirling motion, i.e., swirling velocity energy, is maintained sufficiently.

The diameter of the swirl chambers 22*a*, 22*b*, and 22*c* is so determined that the effects of frictional loss caused by the flow of fuel and frictional loss on the inner wall are minimized. It is said that optimum values of the diameter are approximately 4 to 6 times the hydraulic diameter. In the present embodiment, this principle is adopted.

The relationship among the swirling passages 21*b*, 22*b*, and narrow-angle injection hole 23*b* and the relationship among the swirling passages 21*c*, 22*c*, and wide-angle injection hole 23*c* are the same as the aforementioned relationship among the swirling passage 21*a*, 22*a*, and narrow-angle injection hole 23*a*. Therefore, a description of the former relationship is omitted here.

In the present embodiment, the center axes of the narrow-angle injection holes 23*a*, 23*b*, and wide-angle injection hole 23*c* are parallel to the axis of the fuel injection valve. The center axes may be tilted to provide wider latitude in determining the shapes or pattern of the sprays.

Embodiment 2

A fuel injection valve associated with a second embodiment (embodiment 2) of the present invention is described below by referring to FIGS. 7 and 8.

Figure 8:
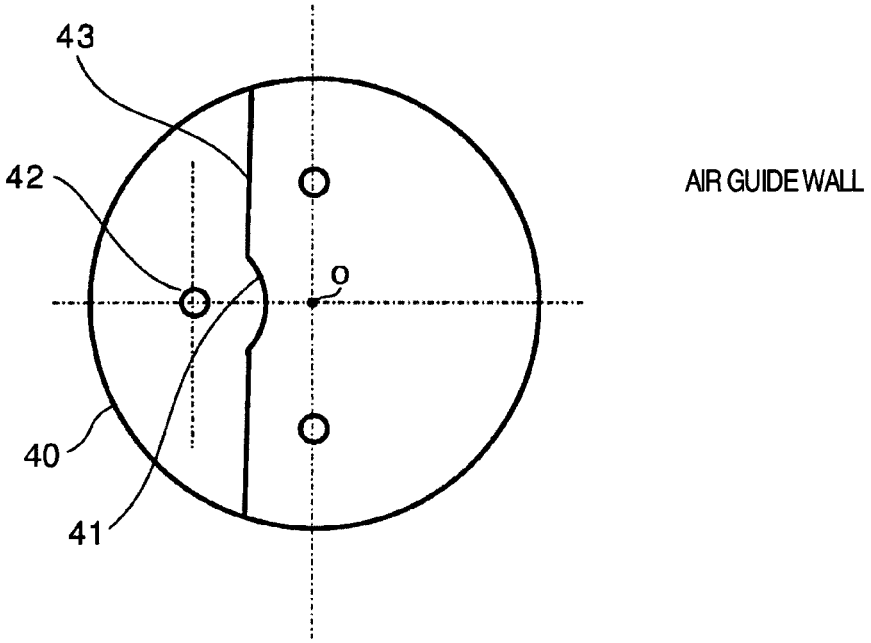
FIG. 8 is a view of the orifice plate shown in FIG. 7, taken from the exit side.

FIG. 8 is a plan view of an orifice plate 40 as viewed from the side of the valve body 6, in the same way as FIG. 3, the orifice plate being located at the lower end of the nozzle body 2 of the fuel injection valve. FIG. 8 is a plan view of the orifice plate 40 located at the lower end of the nozzle body 2 of the fuel injection valve, as viewed from the exit side, in the same way as FIG. 4.

The difference with the fuel injection valve associated with the first embodiment is that the exit surface of the wide-angle injection hole 42 varies in stepwise manner, thus forming a step 43.

Figure 7:
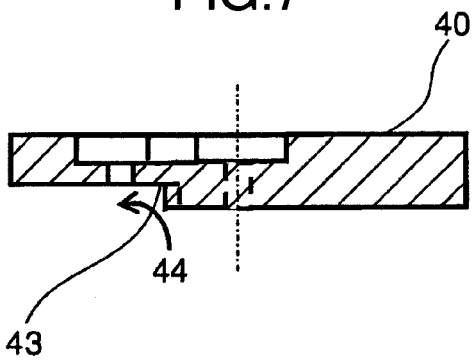
FIG. 7 is a cross-sectional view illustrating a second embodiment of the orifice plate of an embodiment of the fuel injection valve associated with the present invention.

As shown in FIG. 7, the step 43 acts to shorten the axial length of the wide-angle injection hole 42. The step 43 also acts as an air guide wall 41 which partially has a curvature.

Because of this structure, the spray ejected from the wide-angle injection hole 42 forms a wide-angle spray in the same way as in the first embodiment. Flow of air is generated in the liquid film region of this spray (at the outer fringes of the exit of the spray) as indicated by arrow 44 in FIG. 7.

The air guide wall 41 operates to stably generate the flow of air at the outer fringes of the spray. Splitting into liquid films is maintained. As a result, the same advantageous effects as the first embodiment can be obtained.

Embodiment 3

A fuel injection valve associated with a third embodiment (embodiment 3) of the present invention is described below by referring to FIGS. 9 and 10.

Figure 9:
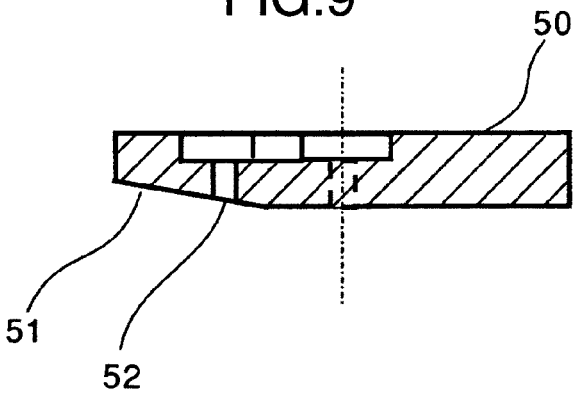
FIG. 9 is a cross-sectional view illustrating a third embodiment of the orifice plate of an embodiment of the fuel injection valve associated with the present invention.

FIG. 9 is a cross-sectional view illustrating a third embodiment of the orifice plate 50 of the fuel injection valve. FIG. 10 is a view of sprays ejected from the fuel injection holes 23*a*, 23*b*, 23*c* arranged as shown in FIG. 3, as taken along the Y-axis. FIG. 10 is a schematic representation of the spray pattern created by the fuel injection valve similarly to FIG. 5, FIG. 10 is a view of the sprays ejected from the wide-angle injection hole 52 and narrow-angle injection holes 53, 54, as taken along the X-axis.

The difference with the fuel injection valve associated with the first embodiment is that the surface of the wide-angle injection hole 52 which is located on the exit side is tilted.

As shown, the tilted portion 51 serves to shorten the axial length of the wide-angle injection hole 52. Substantially, the length of the wide-angle injection hole 52 is laterally nonuniform as shown.

Because of this structure, the spray ejected from the wide-angle injection hole 52 is a wide-angle spray in the same way as in the first embodiment. This spray is tilted to the left through angle $\alpha$ as viewed in FIG. 10.

A deflected spray 57 has been ejected from the wide-angle injection hole 52. Narrow-angle sprays 55 and 56 have been ejected from the narrow-angle injection holes 53 and 54, respectively.

Since fuel is swirled weakly, the narrow-angle sprays 55 and 56 form only narrow angles. The narrow-angle sprays 55 and 56 consist of liquid film regions 55*a* and 56*a* formed over relatively long ranges, split regions 55*b* and 56*b* generated by filamentary liquid generated by flapping caused by a velocity difference with the atmosphere, and atomized spray regions 55*c* and 56*c*, respectively.

On the other hand, the deflected spray 57 becomes a wide-angle spray because fuel is swirled strongly. This deflected spray 57 forms a thinned liquid film and so the liquid film region 57*a* is short. Accordingly, filamentary liquid is generated quickly in the split region 57*b*. Fuel makes a quick transition to the atomized region 57*c*. As a result, the spray travels a shorter distance.

Figure 10:
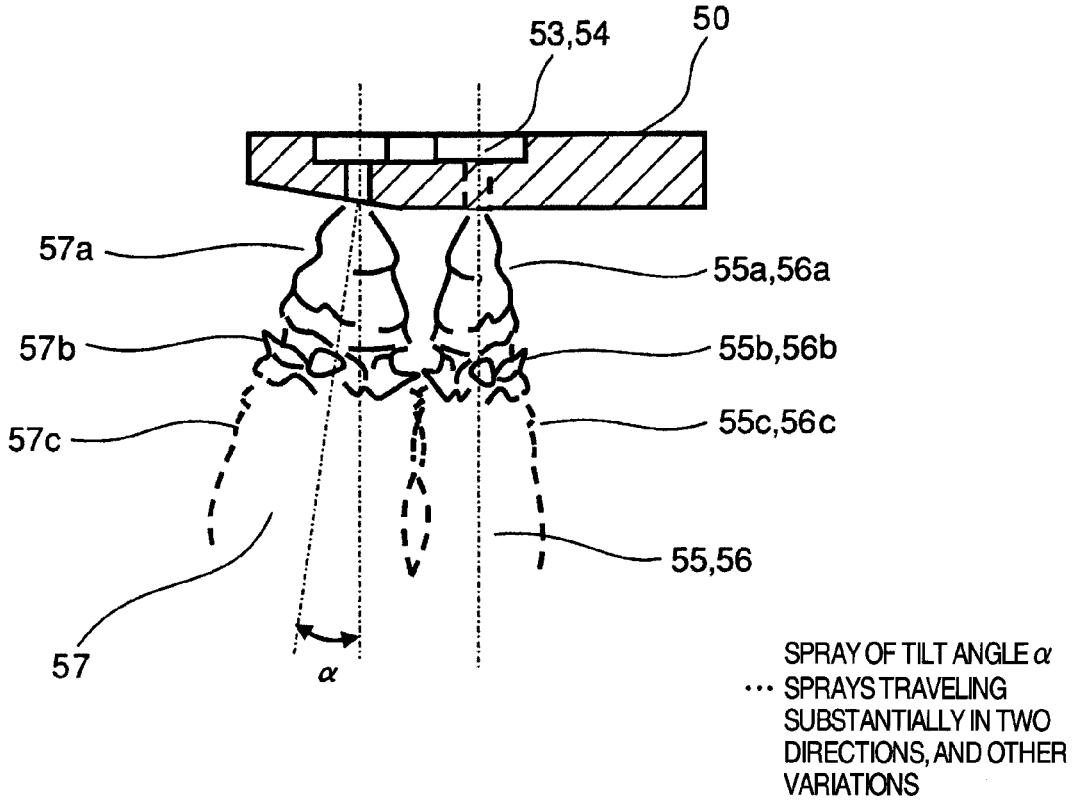
FIG. 10 is a schematic representation of a fuel spray ejected from the fuel injection valves according to a third embodiment of the present invention, the representation being obtained from images derived by optical measurements.

As is obvious from FIG. 10, considerations are given to the narrow-angle sprays 55, 56 and deflected spray 57 such that no collision occurs among the liquid film regions 55*a*, 56*a*, and 57*a*.

Consequently, the same advantageous effects as the first embodiment can be obtained. In any of the above-described embodiments, the diameter of the fuel injection holes is sufficiently large. If the diameter is increased, the cavities formed inside can be increased in size. This can contribute to thinning of film generated by ejected fuel without losing the swirling velocity energy at the injection holes.

If the ratio of the diameter of the injection holes to the depth of the injection holes is reduced, the loss of the swirling velocity energy is reduced to a minimum. Accordingly, the atomization characteristics of fuel are quite excellent.

Furthermore, if the ratio of the diameter of the injection holes to the depth of the fuel injection holes is reduced, the press formability is improved. Of course, this structure contributes to a cost reduction. Additionally, dimensional variations are suppressed by improvement of machinability. Consequently, the robustness of the spray pattern and the spray rate is improved greatly.

An example in which the sprays of the present embodiment is applied to a multicylinder internal combustion engine is next described.

Figure 11:
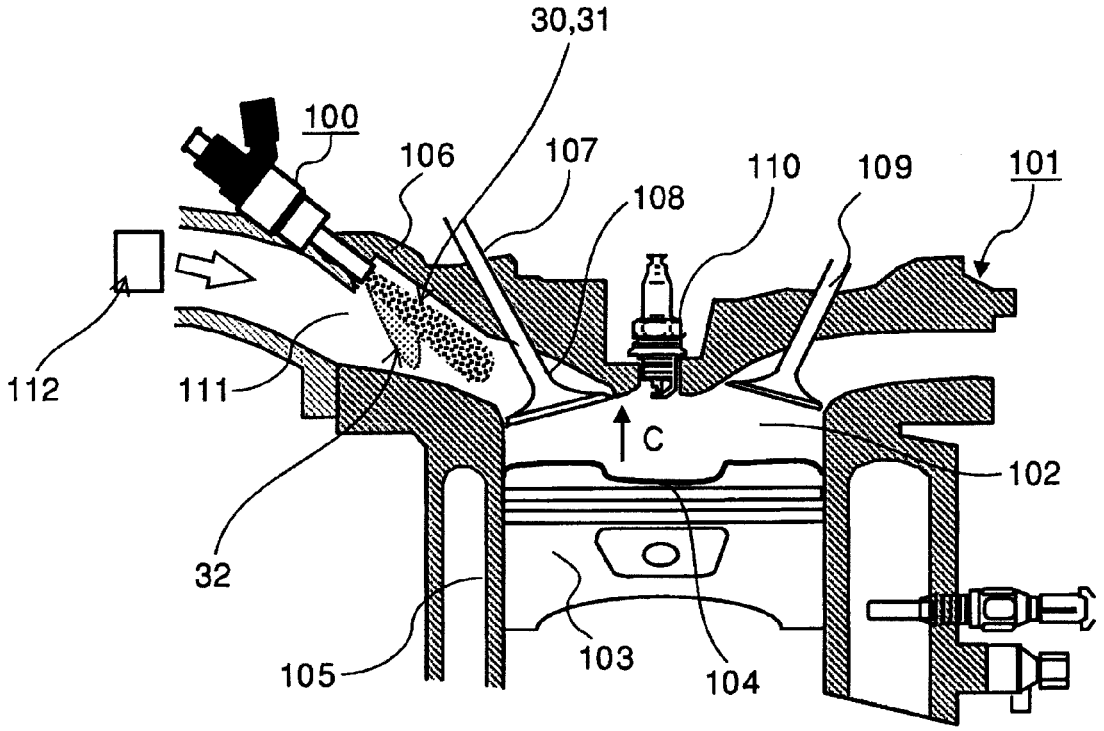
FIG. 11 illustrates the manner in which a fuel injection valve according to one embodiment of the present invention is mounted to the cylinder head of a multipoint fuel injected engine.
Figure 12:
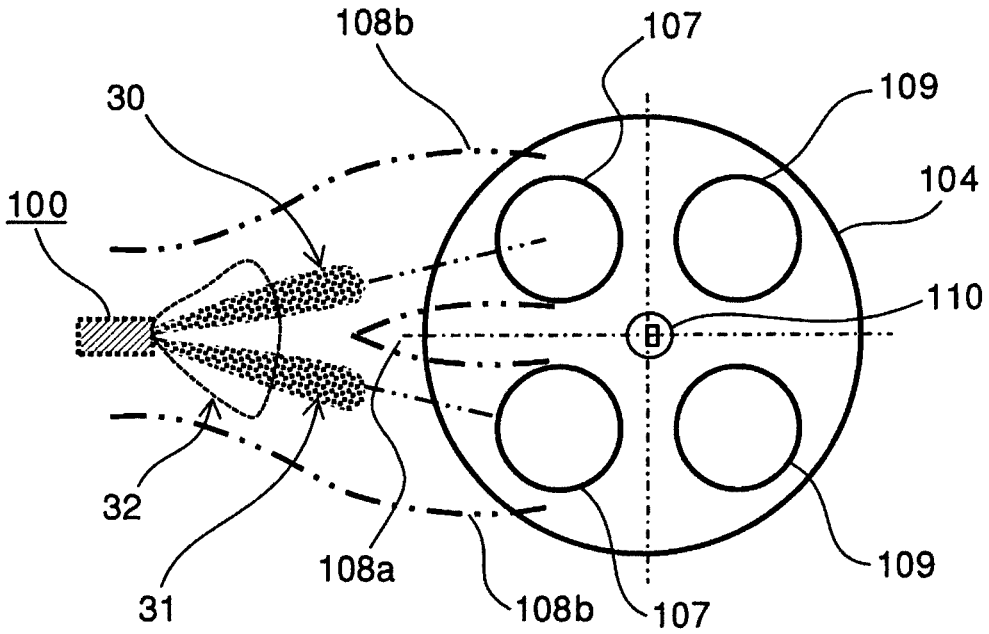
FIG. 12 is a view taken from a direction indicated by arrow C in FIG. 11, showing the positional relationship among the intake valve, fuel injection valves, and sprays.

FIG. 11 is a view showing the manner in which a fuel injection valve is mounted to the cylinder head of a multicylinder internal combustion engine. FIG. 12 is a view taken from a direction indicated by arrow C in FIG. 11, showing the relations among the positions of an intake valve and fuel injection valve 100, and sprays.

Indicated by 101 is one cylinder of the multicylinder internal combustion engine. The fuel injection valve 100 has two intake valves arranged to be directed toward an intake port 108. Also shown are a combustion chamber 102, a piston 103 including a cavity 104, another cylinder 105, and a cylinder head 106. Also shown are intake valves 107, an intake passage 111, exhaust valves 109, an ignition plug 110, and an intake flow controller 112. The intake passage 111 has a central partition wall 108*a* that separates the intake port 108, and is connected on its upstream side. Each fuel injection valve 100 is mounted one by one on the upstream side. A fuel injection system employing multipoint injection is constituted. The fuel injection valves 100 are driven by control signals produced from an engine controller (not shown).

In order to improve the quality and state of the formed air-fuel mixture within the cylinders, the sprays 30, 31, and 32 are more atomized. Furthermore, in order to reduce adhesion of fuel to the inner wall surface of the cylinder head 106 and of the intake passage 111, the directionality and shapes of the sprays are optimized. That is, the sprays from the fuel injection valves 100 of the present embodiment are slightly spread on the inner wall surface of the intake passage 111. Furthermore, as shown in FIG. 12, the sprays are laid out such that adhesion to the central partition wall 108*a* is avoided and that the sprays are directed to the centers of the stems of the intake valves 107.

Especially, high-density portions of the narrow-angle sprays 30 and 31 are directed to the centers of the stems and float near the central partition wall 108*a* of the intake passage 111 to prevent adhesion to the inner wall 108*b*. The wide-angle spray 32 is directed to the wall surface opposite to the wall surface to which the fuel injection valves 100 are mounted. Thus, this spray is carried by the intake flow into the cylinder 105.

Experiments on combustions in the internal combustion engine have shown that the emission performance and fuel consumption have been improved. It has been confirmed that the sprays from the fuel injection valves 100 suppress adhesion of fuel to the inner wall surface of the intake pipe, thus improving the quality and state of the formed air-fuel mixture.

As described so far, a fuel injection valve associated with each embodiment of the present invention has: swirl chambers having inner walls whose curvature increases gradually from upstream to downstream along flow of fuel; passages for swirling motion, the passages permitting introduction of fuel into the swirl chambers; fuel injection holes opening into the swirl chambers; and an orifice plate provided with the injection holes. The fuel injection holes include at least two narrow-angle injection holes and a wide-angle injection hole from which at least two narrow-angle sprays and a wide-angle spray are respectively ejected. The narrow-angle injection holes from which the narrow-angle sprays are ejected are spaced a given distance from the center O of the orifice plate. The wide-angle injection hole from which the wide-angle spray is ejected is formed on a line that perpendicularly intersects a line segment interconnecting the centers of the narrow-angle injection holes.

As a consequence, the narrow-angle spray ejected from the weak swirl chambers 22*a* and 22*b* can prevent scattering of the wide-angle spray, which is ejected from the strong swirl chamber 22*c* and is well atomized, and urge the wide-angle spray downward. Hence, a spray structure having excellent atomization characteristics and shape controllability can be formed.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A fuel injection valve comprising:

swirl chambers each having an inner wall whose curvature is gradually increased from an upstream to a downstream along a flow of fuel direction;

passages for swirling motion, configured to permit introduction of fuel into the swirl chambers;

fuel injection holes opening into the swirl chambers and including at least two narrow-angle injection holes and a wide-angle injection hole from which at least two narrow-angle sprays and a wide-angle spray are respectively ejected; and an orifice plate provided with the injection holes and having a center, wherein the narrow-angle injection holes are spaced a given distance from the center of the orifice plate, the wide-angle injection hole is formed on a bisecting line perpendicularly intersecting a line segment that interconnects centers of the narrow-angle injection holes, and said wide-angle injection hole is smaller in axial length than said narrow-angle injection holes.

2. The fuel injection valve of claim 1, wherein a concavity that is larger in diameter than said wide-angle injection hole is formed on an exit side of the wide-angle injection hole.

3. A fuel injection system comprising:

an intake valve device for opening and closing an intake port;

a fuel injection valve as set forth in claim 1 and activated in response to a control signal from an engine controller, the fuel injection valve being disposed upstream of the intake valve device; and an intake flow controller providing control of an intake flow;

wherein the fuel injection valve is so arranged that the wide-angle spray is directed to the intake flow whose flow is controlled by the intake flow controller.

4. A fuel injection system comprising:

an intake valve device for opening and closing an intake port;

a fuel injection valve as set forth in claim 2 and activated in response to a control signal from an engine controller, the fuel injection valve being disposed upstream of the intake valve device; and an intake flow controller providing control of an intake stream;

wherein the fuel injection valve is so arranged that the wide-angle spray is directed to the intake flow whose flow is controlled by the intake flow controller.

5. The fuel injection system of claim 3, wherein said wide-angle spray is directed to an inner wall facing an inner wall of an intake pipe on which said fuel injection valve is disposed, and wherein said at least two narrow-angle sprays are generated toward the intake valve devices that open and close the intake port.

6. The fuel injection system of claim 4, wherein said wide-angle spray is directed to an inner wall facing an inner wall of an intake pipe on which said fuel injection valve is disposed, and wherein said plural narrow-angle sprays are generated toward the intake valve devices that open and close the intake port.

7. The fuel injection system of claim 1, wherein the bisecting line passes through a center of the wide-angle injection hole and through a center of a center hole of the orifice plate.

* * * * *